US005573387A

United States Patent [19]

Holbrook

[11] Patent Number: 5,573,387

[45] Date of Patent: Nov. 12, 1996

[54] VACUUM PUMPS

[75] Inventor: Alan E. K. Holbrook, Brighton, England

[73] Assignee: The BOC Group plc, Windlesham, England

[21] Appl. No.: 349,697

[22] Filed: Dec. 5, 1994

Related U.S. Application Data

[63] Continuation of Ser. No. 151,089, Nov. 10, 1993, abandoned.

[30] Foreign Application Priority Data

Nov. 13, 1992 [GB] United Kingdom ..... 9223804

[51] Int. Cl.[6] ..... F01C 11/00

[52] U.S. Cl. ..... 418/13; 418/87; 418/97

[58] Field of Search ..... 418/13, 83, 84, 418/87, 97

[56] References Cited

U.S. PATENT DOCUMENTS

| | | | |
|---|---|---|---|
| 4,268,230 | 5/1981 | Bassan | 418/87 |
| 4,838,772 | 6/1989 | LeBlanc | 418/13 |
| 5,066,202 | 11/1991 | Berges et al. | 418/84 |

FOREIGN PATENT DOCUMENTS

| | | | |
|---|---|---|---|
| 0436091 | 2/1992 | Japan | 418/13 |

*Primary Examiner*—Charles Freay
*Attorney, Agent, or Firm*—David M. Rosenblum; Larry R. Cassett

[57] ABSTRACT

A rotary vacuum pump having a low vacuum stage and a high vacuum stage. Each stage includes a stator body having a bore and a rotor mounted eccentrically in the bore to form a cavity between the stator body and the rotor. The rotor of each stage has two vanes slidably positioned in diametrically opposed slots in the rotor which in use of the pump are substantially in contact with an inner wall of the stator body during rotation of the rotor. The stator body of each stage has an inlet and an outlet to allow, in use of the pump, fluid being pumped to enter into and be expelled from the cavity by means of the rotating vanes. Oil to be injected into the low vacuum stage and, when required, into the high vacuum stage also. Differential flow rates (including zero) of ballast gas are introduced to the low vacuum stage, for example in an amount in excess of ten percent of the overall vacuum pump capacity (which equates to the capacity of the high vacuum stage). As a result, the rotary vacuum pump is operable as a one stage or as a two stage pump.

3 Claims, 2 Drawing Sheets

VACUUM PUMPS

This is a continuation of application Ser. No. 08/151,089 filed Nov. 10, 1993, now abandoned.

BACKGROUND OF THE INVENTION

This invention relates to mechanical rotary vacuum pumps and, more particularly, to improvements in the general operating parameters for such pumps.

Rotary vacuum pumps of the type having a rotor mounted for rotation in a stator body and being offset in relation to the stator bore such that two blades contained in, and slidable within, diametrically opposed slots in the rotor can cause gas entering the space between the stator and the rotor to be compressed and expelled into a pump outlet.

Such pumps are typically provided as either a single stage version in which a single rotor is employed or a two-stage version in which a first (high vacuum) stage is backed by a second (low vacuum stage) with the exhaust gases from the first stage being directed, normally via a one-way valve, to the second stage. Generally, the capacity of the high vacuum stage is substantially higher than that of the low vacuum stage, for example by a factor of 4:1.

One stage and two stage pumps are known to possess different operating characteristics. For example, currently available one stage pumps are generally known to possess the ability to handle exhaust stream having a higher vapor content and to have a high throughput. Currently available two-stage pumps, although being able to achieve lower pressures, generally possess inferior vapor handling characteristics and have a lower throughput overall.

Ballasting of the pumps in question is a well-documented technique which enables the pump to cope with a certain amount of vapor without contamination of the pump oil. A gas ballast facility allows atmospheric air (a dry or inert gas can alternatively be used) to be admired to the pump chamber during the compression stage of the rotating blades. This increases the proportion of non-condensable gas in the pump and consequently the partial pressure of the vapor being pumped at the exhaust stage of the pump does not exceed its saturated vapor pressure; the vapor can therefore be discharged without condensing.

Known two-stage pumps tend to have the facility to be ballasted only in the low-vacuum stage as ballasting of the high-vacuum stage can jeopardize the vacuum in the system being evacuated. Equally, the injection of new lubricating oil is also supplied only to the low-vacuum stage. Such ballasting and lubricating features lead, however, to the performance characteristics described above.

In certain circumstances, it would be desirable to provide a two stage pump having as many of the beneficial characteristics as possible of both one and two-stage pumps.

SUMMARY OF THE INVENTION

The invention is concerned with the provision of a two-stage rotary vacuum pump which includes certain feature to enable it selectively to be operated with differing operating characteristics.

In accordance with the invention, there is provided a rotary vacuum pump having a low vacuum stage and a high vacuum stage, each stage including a stator body having a bore and a rotor mounted eccentrically in the bore to form a cavity between the stator body and the rotor, the rotor of each stage having two vanes slidably positioned in diametrically opposed slots in the rotor which in use of the pump are substantially in contact with an inner wall of the stator body during rotation of the rotor, and the stator body of each stage having an inlet and an outlet to allow, in use of the pump, fluid being pumped to enter into and be expelled from the cavity by means of the rotating vanes, wherein:

i) means are provided to enable oil to be injected in to the low vacuum stage and, when required, in to the high vacuum stage also, and ii) means are provided to allow differential flow rates (including zero) of ballast gas to the low vacuum stage, for example in an amount in excess of ten percent of the overall vacuum pump capacity (which equates to the capacity of the high vacuum stage thereby having an ability to operate as a one stage or as a two stage pump.

Generally, extra oil to the high vacuum stage is preferred when there is a continuous high throughput of gas (being pumped), when there is a contaminated gas (eg. carrying solid particles) or when it is required to have a rapid cleansing of the oil.

Ideally the ballast gas flow rate is at least 15% of the pump capacity, most preferably at least 20% or even 30% or higher.

Generally, the provision of ballast gas to the high vacuum stage is not required and may be detrimental. However, the relatively large size of the low vacuum stage coupled with an ability to inject, selectively, oil in to the high vacuum stage enable a range of operating characteristics to be achieved.

Preferably, a facility to introduce ballast gas to the low vacuum stage in different amounts is provided by valve means in which zero flow and predetermined rates of flow can be made. Most preferably, three rates of flow (including zero) are provided, for example at specific rates of zero, of ten percent of the swept volume of the low vacuum stage and of thirty percent of the swept volume of the low vacuum stage.

BRIEF DESCRIPTION OF THE DRAWINGS

For a better understanding of the invention, and to show how the invention may be put into effect, reference will now be made, by way of exemplification only, to the accompanying.

DETAILED DESCRIPTION

Figure 1A:
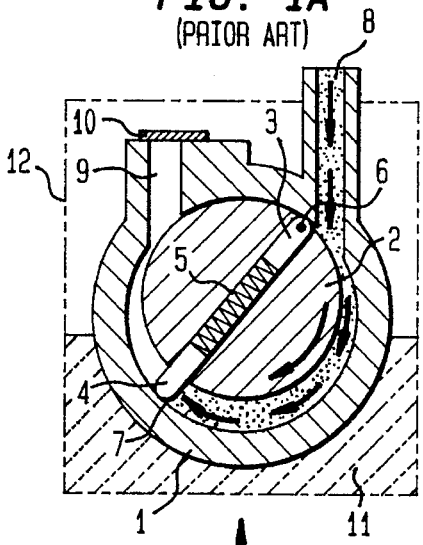
FIG. 1A (PRIOR ART)
FIG. 1 is schematic of a prior art rotary vacuum pump.
Figure 1B:
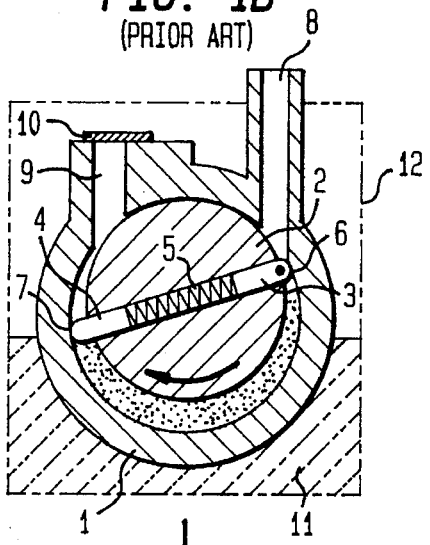
FIG. 1B (PRIOR ART)
Figure 1C:
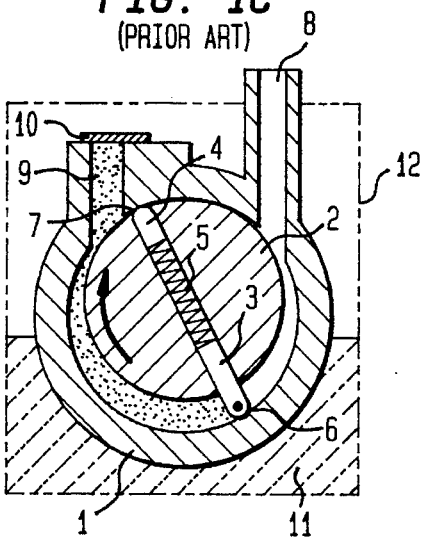
FIG. 1C (PRIOR ART)
Figure 1D:
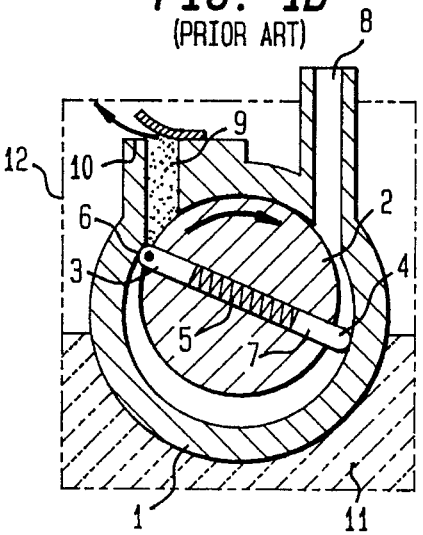
FIG. 1D (PRIOR ART)

A typical arrangement in known pumps is shown schematically in FIG. 1 in the form of four vertical sections through the pump at four different phases thereof (induction, isolation, compression and exhaust). There is shown a stator body 1 having a substantially cylindrical bore within which is eccentrically mounted a rotor 2 for rotation therein about its centre line, i.e. the stator bore is offset in relation to the rotor with the rotor axis being the principal axis of the pump.

The rotor has two diametrically opposed slots within which are situated two blades 3,4 which can slide radially within the slots and are urged outwardly by means of a spring 5 such that the tips 6,7 of the blades 3,4 respectively are in contact with the stator wall at all times.

The stator body 1 has an inlet 8 to the bore and an outlet 9 therefrom, the outlet 9 also having a one-way exhaust valve 10.

The mechanism is generally lubricated by oil 11 contained in the valve body 12 in the form of a reservoir, small amounts of which are pumped into the pump interior to form a thin oil filter between the working components before being ejected back into the reservoir through the exhaust valve 10 together with the pumped gas.

Figure 2:
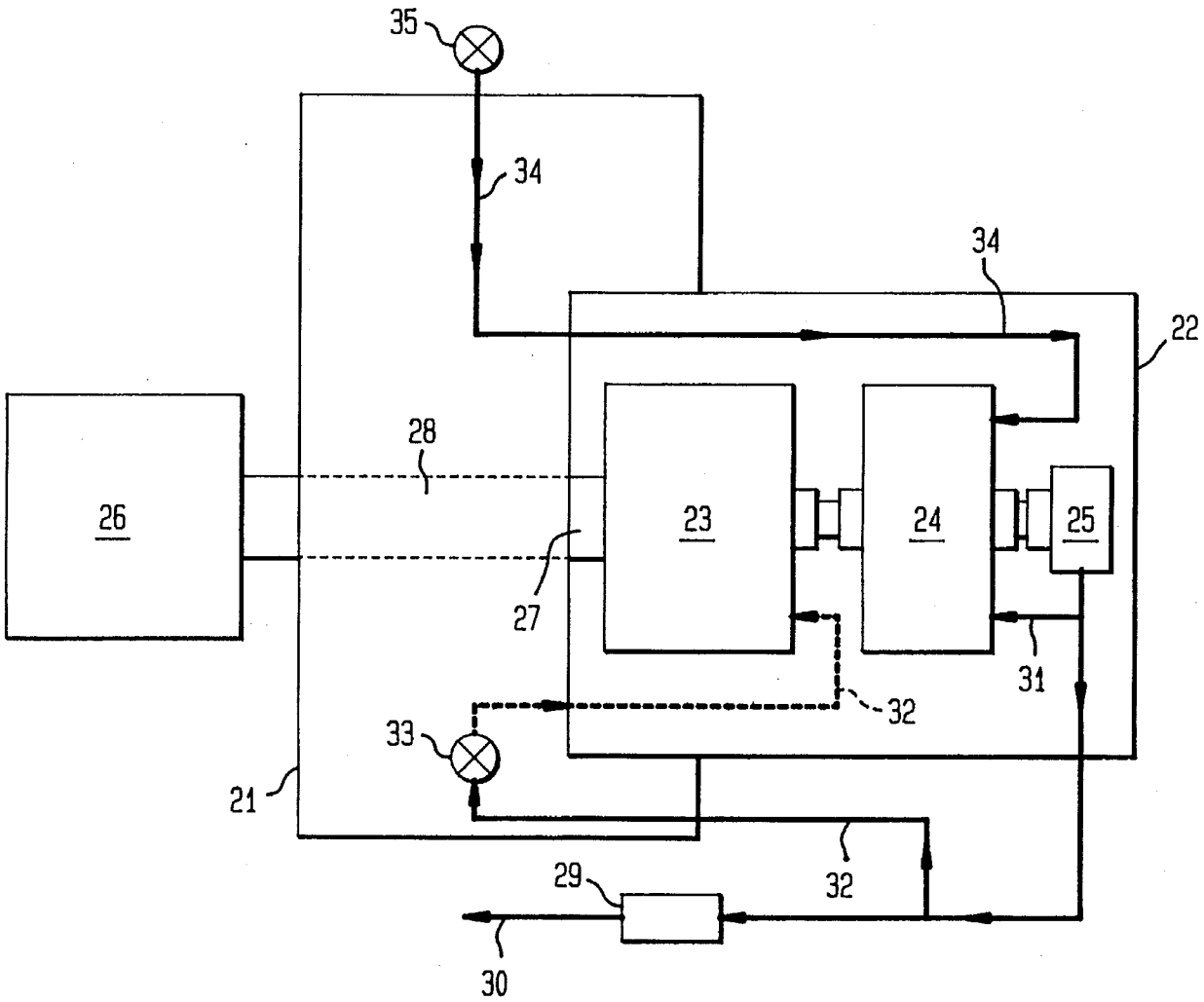
FIG. 2 showing a schematic representation of ballast gas and oil supply lines within a pump of the invention.

With reference to FIG. 2, there is shown a schematic representation of a two-stage vacuum pump of the invention comprising a housing 21 and a stator body 22. Within the stator body 22 is a high vacuum stage 23, a low vacuum stage 24 and an oil pump 25, all of which comprise a rotor capable of rotating within chambers defined in the stator body 2 and having blades slidably contained in slots therein in the manner described above.

Rotation of the rotors 2 or the high vacuum stage 23, the low vacuum stage 24 and the oil pump 25 is effected by a single motor 26 driving the shaft 27 via an adaptor 28. The ratio of the high vacuum stage capacity to the low vacuum stage capacity is about 1.3:1.

The oil pump 25 is present to deliver oil to the vacuum pump generally and in particular to an oil box supplied via a pressure relief valve 29 and an oil line 30. Oil from the oil pump is also supplied under pressure via an oil line 31 to the low vacuum stage 24 on a permanent basis whilst the vacuum pump is operational.

In addition, and in accordance with the invention, a separate oil line 32 is available to supply oil under pressure to the high vacuum stage 23 via an oil switch 23. The switch 35 can be set at "off" so that no oil is supplied directly to the high vacuum stage 23 or at "on" so that a predetermined flow of oil to the high vacuum stage 23 takes place.

Means are also provided in the housing 1 to provide ballasting gas (in the form of dry air) to the low vacuum stage 4 via a ballast line 34. The ballast gas is supplied via the valve 35 which can be set at one of "zero flow" or a first setting providing about ten percent ballast gas of the swept volume of the low vacuum stage or a second setting providing about thirty percent ballast gas of the swept volume of the high vacuum stage.

With the variable oil feed supply facility to the high vacuum stage (in addition to the feed to the low vacuum stage) and the variable gas ballast supply facility to the low vacuum stage, and in the light of the relatively low ratio of high vacuum capacity to low vacuum capacity, the vacuum pumps of the invention can provide a variety of settings (six in the exemplified pump) each of which allows the pump to adopt a variety of working characteristics provided at the various oil supply/ballasting settings. There is shown therein three settings for the ballast flow "Off", "Low" (for example 5, 10 or 15% of pump capacity) and "High" (for example 10, 20 or 30% of pump capacity) and for each setting and oil feed either to the low vacuum stage only or to both low and high vacuum stages. An indication of the type of pump operation at each setting is shown in the Table.

TABLE

| | OIL FEED | |
|---|---|---|
| BALLAST FLOW LOW VAC only | to LOW VAC stage | to LOW VAC and HIGH VAC stages |
| OFF | good ultimate vacuum(2) | high throughput(1) |
| LOW | low vapor handling(2) | low vapor handling and rapid oil cleansing(3) |
| HIGH | high vapor handling(3) | high vapor handling and rapid oil cleansing(1) |

(1)equates to one stage pump operation
(2)equates to two stage pump operation
(3)provides new type of operation

I claim:

1. A rotary vacuum pump comprising: a low vacuum stage; a high vacuum stage; each of the low and high vacuum stages including a stator body having a bore and a rotor mounted eccentrically in the bore to form a cavity between the stator body and the rotor; the rotor of each stage having two vanes slidably positioned in diametrically opposed slots defined in the rotor; the two vanes being substantially in contact with an inner wall of the stator body during rotation of the rotor; the stator body of each of the low and high vacuum stages having an inlet and an outlet to allow fluid being pumped to enter into and to be expelled from the cavity by the rotating vanes; means for injecting oil into the low vacuum stage and into the high vacuum stage; said oil injection means having a user operated switch to selectively cut off oil flow to said high vacuum stage; and means for supplying ballast gas to the low vacuum stage, said ballast gas supply means having selective flow control means for selectively controlling ballast gas flow rate, at and above a zero flow rate.

2. The rotary vacuum pump according to claim 1 in which the control means has three setting comprising a first zero ballast gas flow rate, a second flow rate comprising 10percent of the swept volume of the low vacuum stage and a third flow rate comprising 30 percent of the swept volume of the high vacuum stage.

3. The rotary vacuum pump according to claim 1 in which said flow control means is provided by valve means in which zero flow and predetermined rates of flow can be made.

* * * * *